US007898482B2

(12) United States Patent
Roesner et al.

(10) Patent No.: US 7,898,482 B2
(45) Date of Patent: Mar. 1, 2011

(54) CONDUCTING RADIO FREQUENCY SIGNALS USING MULTIPLE LAYERS

(75) Inventors: Bruce B. Roesner, Durham, NC (US); Wolf Bielas, Chula Vista, CA (US); Jeff Shamblin, San Marcos, CA (US)

(73) Assignee: Sirit Technologies Inc., Toronto (CA)

( * ) Notice: Subject to any disclaimer, the term of this patent is extended or adjusted under 35 U.S.C. 154(b) by 443 days.

(21) Appl. No.: 12/108,870

(22) Filed: Apr. 24, 2008

(65) Prior Publication Data

US 2009/0267862 A1 Oct. 29, 2009

(51) Int. Cl.
*H01Q 1/38* (2006.01)

(52) U.S. Cl. ..... 343/700 MS; 343/846; 340/572.7

(58) Field of Classification Search ..... 343/700 MS, 343/829, 846; 340/572.5, 572.7
See application file for complete search history.

(56) References Cited

U.S. PATENT DOCUMENTS 3,771,075 A * 11/1973 Phelan ..... 333/246
4,700,194 A * 10/1987 Ogawa et al. ..... 343/700 MS
5,905,465 A * 5/1999 Olson et al. ..... 343/700 MS
6,239,762 B1 * 5/2001 Lier ..... 343/770
6,903,687 B1 * 6/2005 Fink et al. ..... 343/700 MS

* cited by examiner

*Primary Examiner*—Tho G Phan
(74) *Attorney, Agent, or Firm*—Fish & Richardson P.C.

(57) ABSTRACT

The present disclosure includes a system and method for conducting radio frequency signals using multiple layers. In some implementations, a signal transfer element configured to passively transfer RF signals between a first region and a second region includes a first conductor layer having a first continuous conductor configured as a first portion of a first antenna, a transmission line, and a first portion of a second antenna. The first antenna and the second antenna are configured to wirelessly receive and transmit Radio Frequency (RF) signals. The signal transfer element also includes a second conductor layer having a second continuous conductor configured as a second portion of the first antenna, a ground plane, and a second portion of the second antenna. The first conductor layer and the second conductor layer are spatially proximate such that the transmission line and the ground plane are configured to passively transfer RF signals between the first antenna and the second antenna independent of an electrical connection between the first conductor layer and the second conductor layer.

18 Claims, 7 Drawing Sheets

CROSS SECTION

CONDUCTING RADIO FREQUENCY SIGNALS USING MULTIPLE LAYERS

TECHNICAL FIELD

This invention relates to detecting radio frequency signals and, more particularly, to conducting radio frequency signals using multiple layers.

BACKGROUND

In some cases, an RFID reader operates in a dense reader environment, i.e., an area with many readers sharing fewer channels than the number of readers. Each RFID reader works to scan its interrogation zone for transponders, reading them when they are found. Because the transponder uses radar cross section (RCS) modulation to backscatter information to the readers, the RFID communications link can be very asymmetric. The readers typically transmit around 1 watt, while only about 0.1 milliwatt or less gets reflected back from the transponder. After propagation losses from the transponder to the reader the receive signal power at the reader can be 1 nanowatt for fully passive transponders, and as low as 1 picowatt for battery assisted transponders. At the same time other nearby readers also transmit 1 watt, sometimes on the same channel or nearby channels. Although the transponder backscatter signal is, in some cases, separated from the readers' transmission on a sub-carrier, the problem of filtering out unwanted adjacent reader transmissions is very difficult.

SUMMARY

The present disclosure includes a system and method for conducting radio frequency signals using multiple layers. In some implementations, a signal transfer element configured to passively transfer RF signals between a first region and a second region includes a first conductor layer having a first continuous conductor configured as a first portion of a first antenna, a transmission line, and a first portion of a second antenna. The first antenna and the second antenna are configured to wirelessly receive and transmit Radio Frequency (RF) signals. The signal transfer element also includes a second conductor layer having a second continuous conductor configured as a second portion of the first antenna, a ground plane, and a second portion of the second antenna. The first conductor layer and the second conductor layer are spatially proximate such that the transmission line and the ground plane are configured to passively transfer RF signals between the first antenna and the second antenna independent of an electrical connection between the first conductor layer and the second conductor layer.

DESCRIPTION OF DRAWINGS

Like reference symbols in the various drawings indicate like elements.

DETAILED DESCRIPTION

Figure 1:
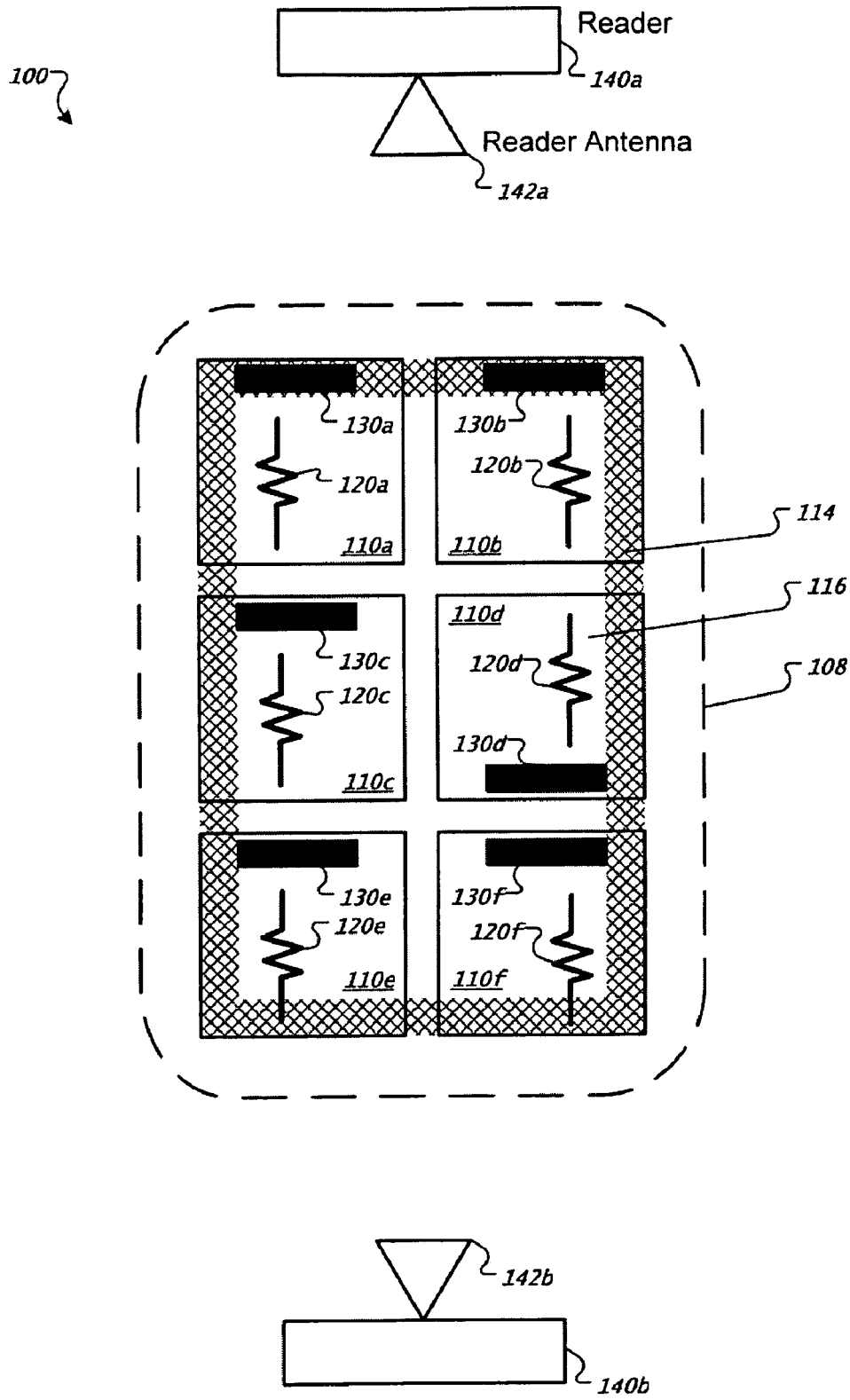
FIG. 1 is a block diagram of a transfer system for passively transferring radio frequency signals.

FIG. 1 is a top-view block diagram illustrating an example system 100 for conducting radio frequency (RF) signals between antennas in accordance with some implementations of the present disclosure. For example, the system 100 may passively transfer RF signals between antennas independent of interconnects between conductor levels. In some implementations, the system 100 may include an energy transfer medium having multiple conductor levels. For example, the passive energy transfer medium may include a first level forming a leg for each of two antennas that is connected using grounding plane and a second level forming a different leg for each of the two antennas that is connected using transmission line. In these implementations, the system 100 may be configured such that the two conductor levels are spatially proximate such that RF signals are passively transferred between two antennas independent of an electrical connection between the two conductor levels (e.g., interconnects, vias). For example, the distance between the conductor levels may be 2 to 20 mils. In addition, each conductor level may be formed using a continuous conductor. A continuous conductor may be a conductor configured to transmit incident RF signals from one location to a different location independent of physical connections. For example, physical connections may include soldered connections, mechanical connections, and/or other electrical connections. In some implementations, each conductor level may be formed using striplines, microstrips, and/or other continuous conductors. In some implementations, the system 100 may include multiple ground planes spatially proximate a transmission line such that RF signals are transferred between antennas independent of interconnects, vias, discrete connectors, or other electrical connections. By passively transferring RF signals independent of electrical connections between conduction layers, the system 100 may decrease, minimize, or otherwise reduce the cost associated with passive transmission media by reducing the number of connections, the number of manufacturing steps, and/or attenuation of the RF signal being passively transferred.

In some implementations, the system 100 can passively transfer radio frequency signals to obstructed RF IDentifiers (RFIDs) using such energy transfer media. The system 100 may include goods at least partially in containers. In managing such goods, the system 100 may wirelessly transmit RF signals to request information identifying these goods. In some cases, the RF signals may be attenuated by, for example, other containers, packaging, and/or other elements. For example, the system 100 may include containers with RFID tags that are stacked on palettes and are not located on the periphery. In this case, RF signals may be attenuated by other containers and/or material (e.g., water). In some implementations, the system 100 may passively transfer RF signals to tags otherwise obstructed. For example, the system 100 may include one or more transfer media that passively transfers RF signals between interior tags and the periphery of a group of containers.

At a high level, the system 100 can, in some implementations, include a group 108 including containers 110*a-f*, energy-transfer media 120*a-f*, RFID tags 130*a-f*, and readers 140*a-b*. Each container 110 includes an associated RFID tag 130 that wirelessly communicates with the readers 140. In some cases, the RFID tag 130 may reside in an interior region 116 of the group 108 not at or proximate the periphery 114. In this case, the energy-transfer medium 120 may passively transfer RF signals between interior RFID tags 130 and the readers 140. In other words, the transmission path between reader 140 and interior tags 130 may include both wired and wireless connections. For example, the group 108 may be a shipment of produce, and the containers 110 may be returnable plastic containers (RPCs) or crates, which are commonly used worldwide to transport produce. In some cases, produce is composed primarily of water, which may significantly attenuate RF signals and interfere with RFID tags 130*c*-130*f* in the interior region 116 from directly receiving RF signals. In this example, the energy transfer media 120 may transmit RF signals between the periphery 114 and the interior region 116 enabling communication between the RFID readers 140 and the RFID tags 130*a-f*. The system 100 may allow the produce shipment to be tracked and/or inventoried more easily, since each RPC can be identified by RFID while the shipment is stacked or grouped. While the examples discussed in the present disclosure relate to implementing RFID in stacked or grouped containers, the system 100 may be useful in a variety of other implementations. In some examples, the system 100 may be applied to the top surface of pallets to allow communication with boxes stacked on the pallet. In some examples, the system 100 may be applied to cardboard boxes by placing the antennas on different surfaces and bending the transmission line around the edges and/or corners.

Turning to a more detailed description of the elements, the group 108 that may be any spatial arrangement, configuration and/or orientation of the containers 110. For example, the group 108 may include stacked containers 110 arrange or otherwise positioned on a palette for transportation. In some implementations, the group 108 may be a horizontal two-dimensional (2D) matrix (as illustrated), a vertical 2D matrix, a 3D matrix that extends vertically and horizontally, and/or a variety of other arrangements. The group 108 may be arranged regardless of the orientation and/or location of the tags 130. The containers 110 may be any article capable of holding, storing or otherwise at least partially enclosing one or more assets (e.g., produce, goods). For example, the containers 110 may be RPCs including produce immersed in water. In some implementations, each container 110 may include one or more tags 130 and/or energy-transfer media 120. In some examples, the tag 130 and/or the media 120 may be integrated into the container 110. In some examples, the tag 130 and/or the medium 120 can be affixed to the container 110. In some implementations, one or more of the containers 110 may not include a tag 130. In some implementations, the containers 110 may be of any shape or geometry that, in at least one spatial arrangement and/or orientation of the containers 110, facilitates communication between one or more of the following: tags 130 of adjacent containers 110, energy transfer media 120 of adjacent containers 110, and/or between tags 130 and energy transfer media 120 of adjacent containers. For example, the geometry of the containers 110 may include right angles (as illustrated), obtuse and/or angles, rounded corners and/or rounded sides, and a variety of other features. In some implementations, the containers 110 may be formed from or otherwise include one or more of the following: cardboard, paper, plastic, fibers, wood, and/or other materials. In some implementations, the geometry and/or material of the containers 110 may vary among the containers 110 in the group 108.

The energy transfer media 120 can include any software, hardware, and/or firmware configured to passively transfer RF signals between two antennas independent of electrical connections between conductor layers. For example, the media 120 may include a transmission plane and a ground plane for passively transferring RF signals between antennas without an electrical connection between the planes. In general, the media 120 may wirelessly receive an RF signal at one portion (e.g., first antenna) and re-emit the signal from a different portion of the media 120 (e.g., second antenna). The media 120 can, in some implementations, receive signals from or transmit signals to the RFID antennas 142, the RFID tags 130, and/or other energy-transfer media 120. For example, the RFID reader 140 may transmit an RF signal incident the periphery 114, and the media 120 may receive and re-transmit the signal to an interior tag 130. In some implementations, the media 120 can be at least a portion of a communication path between the RFID reader 140 and the RFID tag 130. For example, the media 120 may transfer RF signals between the periphery 114 and the interior 114 of the group 108. In doing so, the media 120 may establish communication paths to tags 130 otherwise unable to directly communicate with the reader 140.

In some implementations, the media 120 may include two continuous conductors such that each forms a different conductor layer and passively transfers RF signals independent of an electrical connection between the layers. As previously mentioned, such electrical connections may include vias, interconnects, and/or others. In some implementations, a first conductor level of the media 120 may form a first leg of each antenna such that each leg is connected by a ground plane, and a second conductor layer of the media 120 may form a second leg of each antenna such that each leg is connected by a transmission line. In the case that the conductor layers are spatially proximate, the media 120 may passively transfer RF signals independent of an electrical connection between the layers. For example, the media 120 may include a dielectric layer that separates the conductor layers by 20 mils or less. In some implementations, the media 120 may include one or more of the following: antennas, microstrips, striplines, and/or any other features that passively transfer RF signals. In some implementations, the media 120 may include multiple ground planes that are spatially proximate a transmission line. For example, the multiple ground planes may be formed by folding a ground plane around a transmission line. In addition, the media 120 may passively transfer RF signals between locations independent of physical connections along the transmission path. As mentioned previously, physical connections may include solder connections, mechanical connections, and/or other connections for connecting at least two elements of the media 120 (e.g., antenna legs and transmission line). In some implementations, each conductor layer of the energy transfer media 120 may be fabricated separately and later affixed to form the energy transfer media 120. The media 120 may be fabricated separately from and later attached or otherwise affixed to the container 110. The energy transfer media 120 may be integrated into at least a portion of the container 110. For example, the container 110 may be an RPC with an energy transfer medium 120 built into its structure. The energy transfer media 120 may include a variety of geometries, placements and/or orientations with respect to the tags 130 and/or containers 110. For example, the energy transfer media 120 may bend or curve around or through any interior or exterior feature of the container 110, such as corners, edges and/or sides. In some implementations, the media 120 includes directional antennas configured to, for example, increase transmission efficiency. In some implementations, the media 120 may be, for example, approximately six inches, 14 inches, and/or other lengths.

The RFID tags 130 can include any software, hardware, and/or firmware configured to backscatter RF signals. The tags 130 may operate without the use of an internal power supply. Rather, the tags 130 may transmit a reply to a received signal using power stored from the previously received RF signals independent of an internal power source. This mode of operation is typically referred to as backscattering. The tags 130 can, in some implementations, receive signals from or transmit signals to the RFID antennas 142, energy transfer media 120, and/or other RFID tags 130. In some implementations, the tags 130 can alternate between absorbing power from signals transmitted by the reader 140 and transmitting responses to the signals using at least a portion of the absorbed power. In passive tag operation, the tags 130 typically have a maximum allowable time to maintain at least a minimum DC voltage level. In some implementations, this time duration is determined by the amount of power available from an antenna of a tag 130 minus the power consumed by the tag 130 to charge the on-chip capacitance. The effective capacitance can, in some implementations, be configured to store sufficient power to support the internal DC voltage when the antenna power is disabled. The tag 130 may consume the stored power when information is either transmitted to the tag 130 or the tag 130 responds to the reader 140 (e.g., modulated signal on the antenna input). In transmitting responses, the tags 130 may include one or more of the following: an identification string, locally stored data, tag status, internal temperature, and/or others.

The RFID readers 140 can include any software, hardware, and/or firmware configured to transmit and receive RF signals. In general, the RFID reader 140 may transmit request for information within a certain geographic area, or interrogation zone, associated with the reader 140. The reader 140 may transmit the query in response to a request, automatically, in response to a threshold being satisfied (e.g., expiration of time), as well as others events. The interrogation zone may be based on one or more parameters such as transmission power, associated protocol, nearby impediments (e.g., objects, walls, buildings), as well as others. In general, the RFID reader 140 may include a controller, a transceiver coupled to the controller (not illustrated), and at least one RF antenna 142 coupled to the transceiver. In the illustrated example, the RF antenna 142 transmits commands generated by the controller through the transceiver and receives responses from RFID tags 130 and/or energy transfer media 120 in the associated interrogation zone. In certain cases such as tag-talks-first (TTF) systems, the reader 140 may not transmit commands but only RF energy. In some implementations, the controller can determine statistical data based, at least in part, on tag responses. The readers 140 often includes a power supply or may obtain power from a coupled source for powering included elements and transmitting signals. In some implementations, the reader 140 operates in one or more of frequency bands allotted for RF communication. For example, the Federal Communication Commission (FCC) have assigned 902-928 MHz and 2400-2483.5 MHz as frequency bands for certain RFID applications. In some implementations, the reader 140 may dynamically switch between different frequency bands.

In one aspect of operation, the reader 140 periodically transmits signals in the interrogation zone. In the event that the transmitted signal reaches an energy transfer medium 120, the energy transfer medium 120 passively transfer the incident RF signal along a continuous conductor to different location and re-transmit the RF signal. The re-transmitted signal may then be received by another energy transfer medium 120, a tag 130, or a reader 140.

Figure 2A:
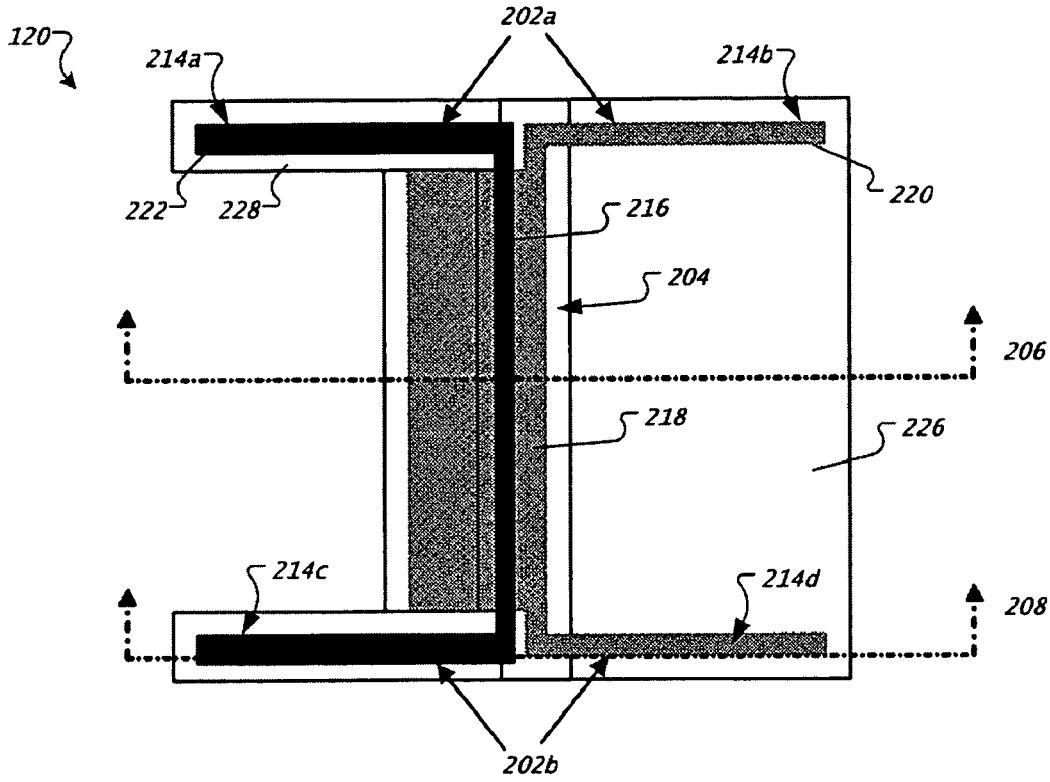
FIGS. 2A-F are block diagrams illustrating example energy transfer media.
Figure 2B:
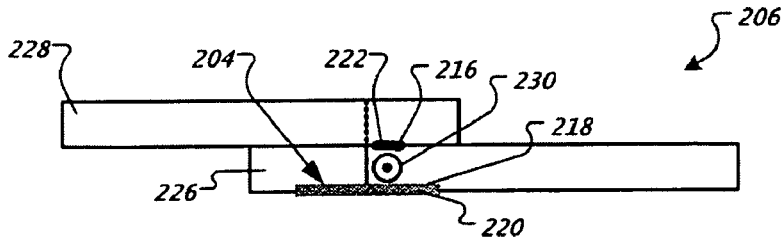
Figure 2C:
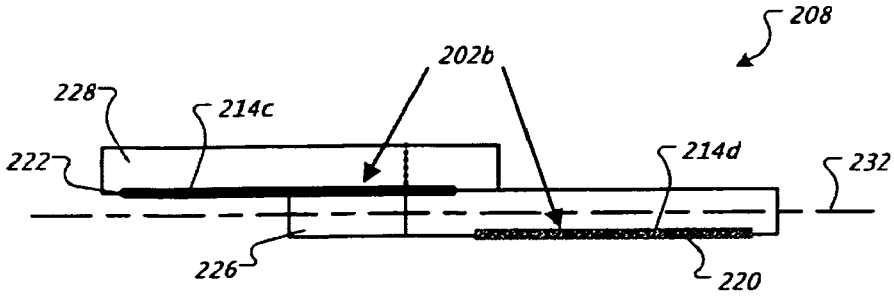
Figure 2D:
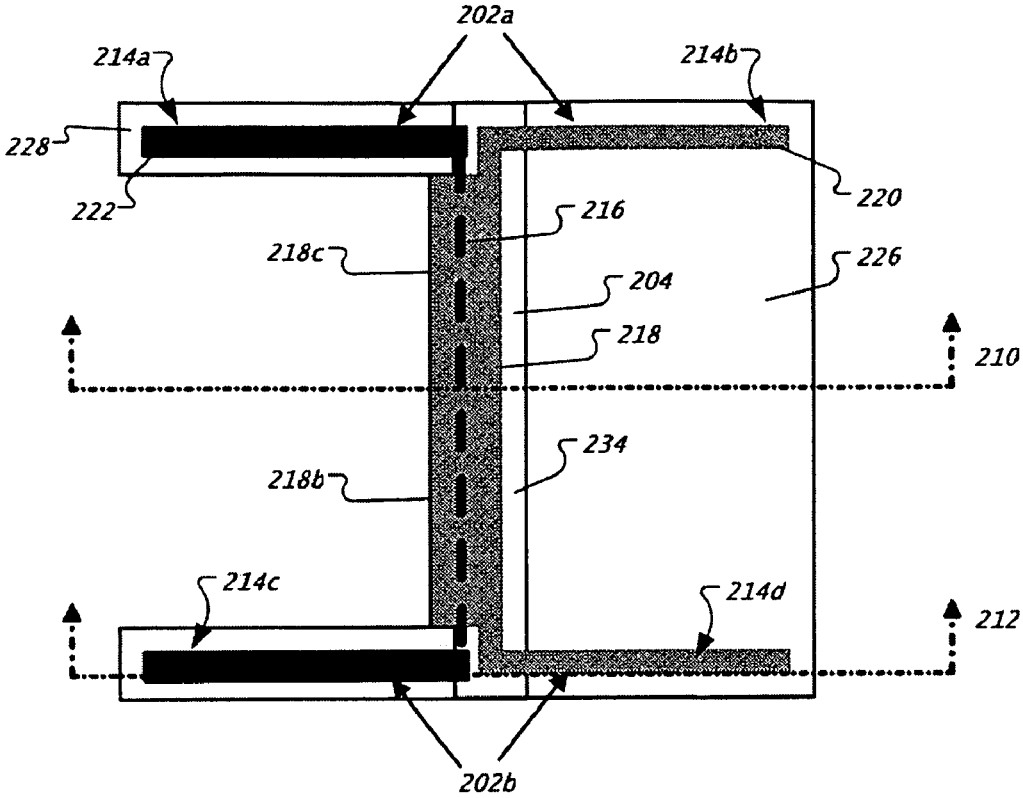
Figure 2E:
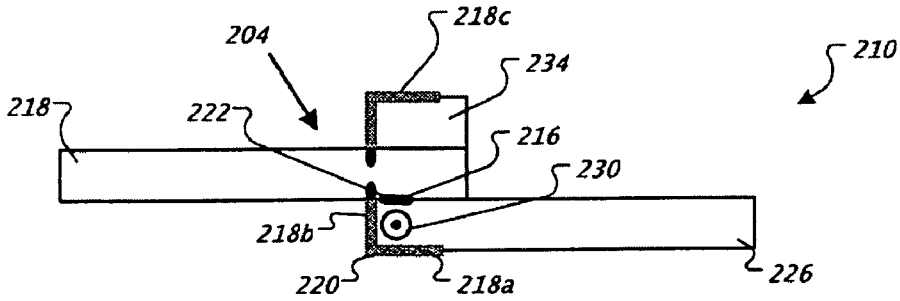
Figure 2F:
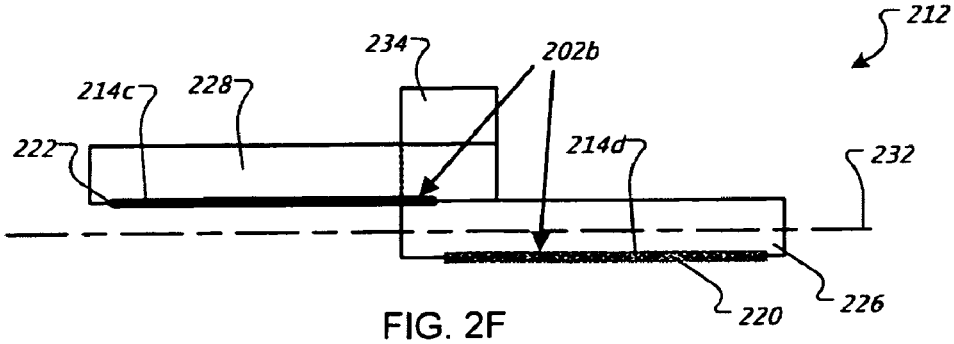

FIGS. 2A-F are diagrams illustrating example energy transfer media 120 for passively transferring RF signals using multi-conductor layers independent of electrical connections. FIG. 2A is a plan view of energy transfer medium 120, which includes antennas 202*a*, 202*b* and a passive transmission path 204. FIGS. 2B and 2C illustrate the energy transfer medium cross sections 206 and 208, respectively. FIG. 2D is a plan view of energy transfer medium 120, which includes antennas 202*a*, 202*b* and passive transmission path 204. FIGS. 2E and 2F illustrate the energy transfer medium cross sections 210 and 212, respectively.

Each of the antennas 202*a* and 202*b* includes two antenna legs 214. The antenna 202*a* includes legs 214*a* and 214*b*. The antenna 202*b* includes the antenna legs 214*c* and 214*d*. The passive transmission path 204 include a transmission line 216 and a ground plane 218. In some implementations, the transmission line 216 and the ground plane 218 are microstrips. The passive transmission path 204 of FIG. 2D includes a transmission line 216 and ground planes 218*a-c*. In some implementations, the transmission line 216 and the ground planes 218*a-c* can be a printed pattern of conducting material such as a copper pattern printed on Mylar. As illustrated, the conductor layer 220 including the leg 214*b*, the ground plane 218, and the leg 214*d* are printed as a first continuous conductor, and the second conductor layer 222 including the leg 214*a* , the transmission line 216, and the leg 214*c* are printed as a second continuous conductor.

Turning to FIG. 2A, the passive transmission path 204 may passively transfer signals between the antennas 202*a* and 202*b*. For example, the first antenna 202*a* may receive an RF signal (e.g., wirelessly from a reader 140), the passive transmission path 204 may transfer the signal to the second antenna 202*b*, and the second antenna 202*b* may retransmit the signal (e.g., for wireless communication with a tag 130). In the illustrated examples, the energy transfer media 120 each include multiple substantially planar layers of conducting material and/or insulating material. However, in some implementations, the energy transfer media 120 are implemented as three dimensional structures. For example, the energy transfer medium 120 may bend, curve or otherwise deviate to accommodate the shape or contents of a container 110.

The energy transfer medium 120 illustrated in FIG. 2A is implemented as a layered structure. The layered structure forming the energy transfer medium 120 may be implemented independent of wirings, solder, and/or other electrical connections (e.g., vias) between the conductor layers. Two cross-sectional views illustrating the layers of the energy transfer medium 120 at axes 206 and 208 are illustrated in FIGS. 2B and 2C respectively. The layered structure may include alternating layers of conducting material and insulating material. The first conductor layer 220 (illustrated gray) includes the leg 214*b*, the ground plane 218 and the leg 214*d*. A first insulating layer 226 separates the first conductor layer 220 and a second conductor layer 222 (illustrated black). The second conductor layer 222 includes the leg 214*a*, the transmission line 216 and the leg 214*c*. A second insulating layer 228 is illustrated adjacent to the second conductor layer 222, opposite the first insulating layer 226. The layered structure may be fabricated, for example, by printing conducting strips on a substrate of insulating material. For example, the conductor layer 220 may be printed on the insulating layer 226, the conductor layer 222 may be printed on the insulating layer 228, and the two resulting structures may be attached using, for example, an adhesive. Alternatively, the layered structure may be fabricated by printing the conducting material on either side of a single insulating material substrate. For example, the conductor layer 220 may be printed on a first side of an insulating layer, and the conductor layer 222 may be printed on the other side of the same insulating layer. The insulating layers 226 and 228 may be made of any appropriate insulating material, such as Mylar. The thickness of the insulating layer may be determined by the specifications of the energy transfer medium 120, by the fabrication process or materials, and/or by the specifications of the container 110. In some example implementations, the insulation layers 226 and 228 can range from 2 to 10 millimeters thick, but the insulation layers 410 may be a different thickness according to other implementations.

FIG. 2B is a cross-sectional view of the example passive transmission path 204, along the axis 206. The insulating layer 226 separates the ground plane 218 from the transmission line 216. These three layers 216, 218, and 226, which may extend from the first antenna 202*a* to the second antenna 202*b*, may define a microstrip for transferring RF signals between the two antennas 202*a* and 202*b*. The ground plane 218 may serve as a ground or reference plate for the microstrip transfer line. In the illustrated example, the ground plane 218 is wider than the transmission line 216. However, the transmission line 216 and the ground plane 218 may be in a different relative proportion in other implementations. For example, the ground plane 218 may, in some implementations, be wider than or the same width as the transmission line 216. The transmission line 216 and the ground plane 218 may define a primary axis 230 of the passive transmission path 204. The illustrated axis 230 extends straight in the direction substantially perpendicular to the antennas 202*a* and 202*b*. However, in some implementations, the primary axis 230, as defined by the transmission line 216 and the ground plane 218, can bend, curves or otherwise deviate along a contour, edge, and/or corner of a container 110.

FIG. 2C is a cross-sectional view of the example antenna 202*b*, along the axis 208. The insulating layer 226 separates the leg 214*d* from the leg 214*c*. The two legs 214*c* and 214*d* define a primary axis 232 of the antenna 202*b*. The illustrated axis 232 extends straight in the direction substantially perpendicular to the passive transmission path 204. However, in some implementations, the primary axis 232, as defined by the legs 402*c* and 402*d*, bends, curves or otherwise deviates along, for example, a contour, edge, and/or corner of a container 110. The antennas 202*a* and 202*b* may be implemented as biplanar structures with no interconnections between the two layers. Additionally, the antennas 202*a* and 202*b* may be connected to the passive transmission path 204 without conductive interconnections between the two layers. The separation distance between the two planes, as defined by the insulating layer 226, may be small enough that the antenna functions substantially as a single plane antenna. For example, compared to the length scales of the RF signals transmitted and received by the antennas 202*a* and 202*b*, the thickness of the insulating layer 226 may be very small such as 100 times smaller. As a specific example, a 900 MHz RF signal received by the antenna 202*a* has a wavelength of approximately 300 millimeters, and the thickness of the insulating layer 226 may be 10 millimeters.

In one aspect of operation, the antenna 202*a* wirelessly receives an RF signal transmitted from a reader 140. The received RF signal is transferred along the transmission path 204 to the antenna 202*b*. Then the antenna 202*b* wirelessly re-transmits the received RF signal. The re-transmitted RF signal may then be received, for example, by another antenna 202 or a tag 130.

In some implementations, the example energy transfer medium 120 illustrated in FIGS. 2D-F may include some of the same elements as the example energy transfer medium 120 illustrated in FIGS. 2A-C. The energy transfer medium 120 of FIGS. 2D-F also includes two additional grounding planes 218*b* and 218*c* and an additional insulating layer 234. As illustrated, the insulating layer 234 is adjacent to the conductor layer 228. In some implementations, the insulating layer 234 can be omitted. The ground planes 218*b* and 218*c* may be included in the passive transmission path 204 to define a stripline transmission line configuration. For example, the conducting strip 218*b* may function as a second ground or reference plate, in addition to the ground plane 218*a*. The insulating layers 228 and 234 separate the transmission line 222 from a third ground plane 218*c*. The ground plane 218*c* is connected to the ground plane 218*a* by the ground plane 218*b*. The stripline configuration of FIGS. 2D-F may be formed from the microstrip configuration of FIG. 2A-C by folding a portion of the ground plane 218 up and around the transmission line 216 (e.g., folding a portion of 218 out of the page, in FIG. 2A). In this way, the passive transmission path 204 of FIGS. 2D-F may be implemented without vias, soldered connections, and/or other connections between the conductor layers.

Figure 3:
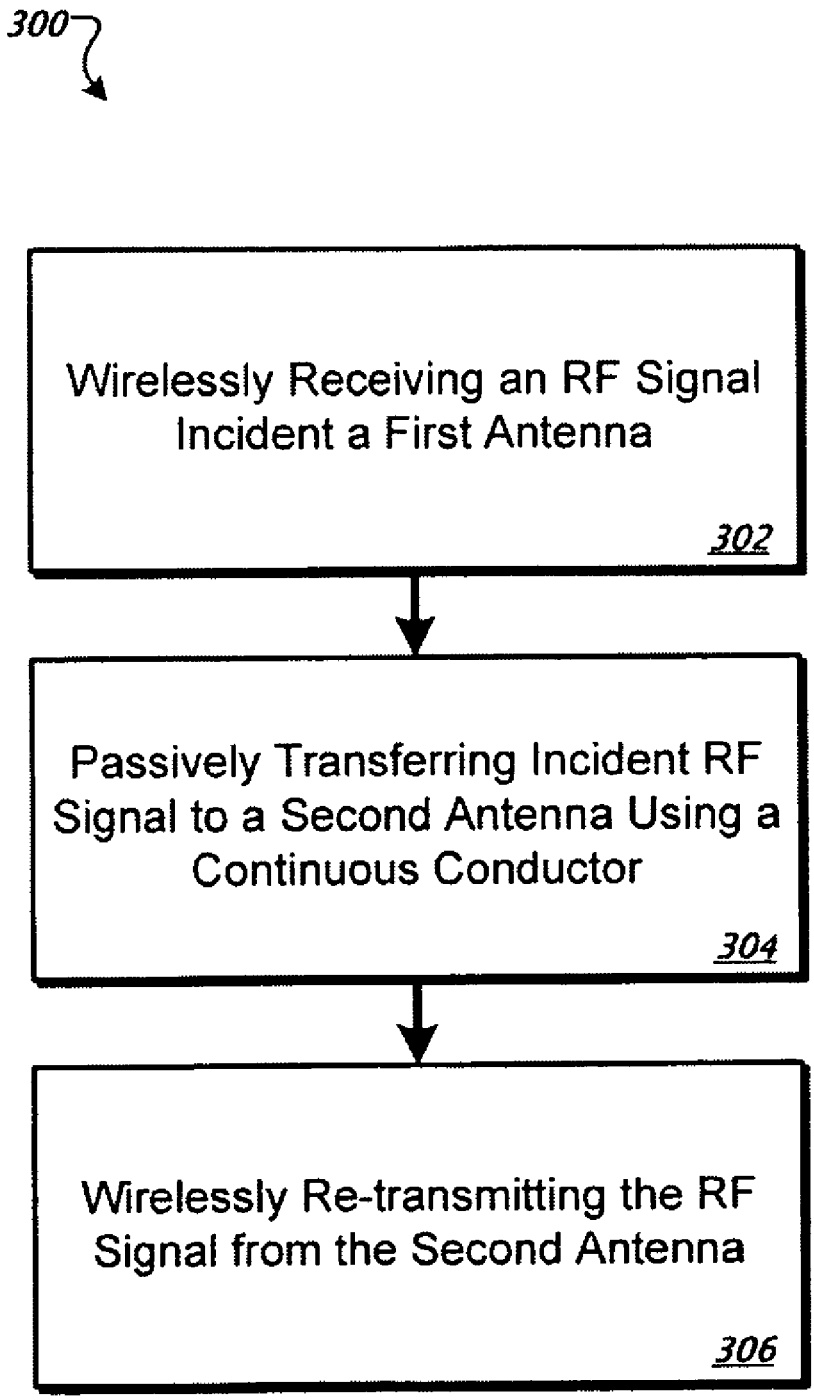
FIG. 3 is a flow chart illustrating an example method for passively transferring radio-frequency signals.

FIG. 3 is a flow chart illustrating an example method 300 for passively transferring RF signals between a first region of a container and a second region of the container. In particular, the example method 300 describes a technique for passively communicating RF signals using the energy transfer media 120 of FIGS. 2A-C. The RF signal may be received from the readers 140, the tags 130, or a different energy transfer medium 120. The method 300 is an example method for one aspect of operation of the system 100; a similar method, including some, all, additional, or different steps, consistent with the present disclosure, may be used to manage the system 100.

The method 300 begins at step 302, where an RF signal is wirelessly received using a first antenna. Next, at step 304, the incident RF signal is passively transferred to a second antenna using a continuous conductor. For example, a leg of the first antenna, a transmission path, and a leg of the second antenna may be continuous conductor independent of physical connections (e.g., soldered connections). Finally, at step 306, the RF signal is wirelessly re-transmitted using the second RF antenna. The re-transmitted RF signal may be received by a reader 140, a tag 130, or a different energy transfer medium 120.

Figure 4A:
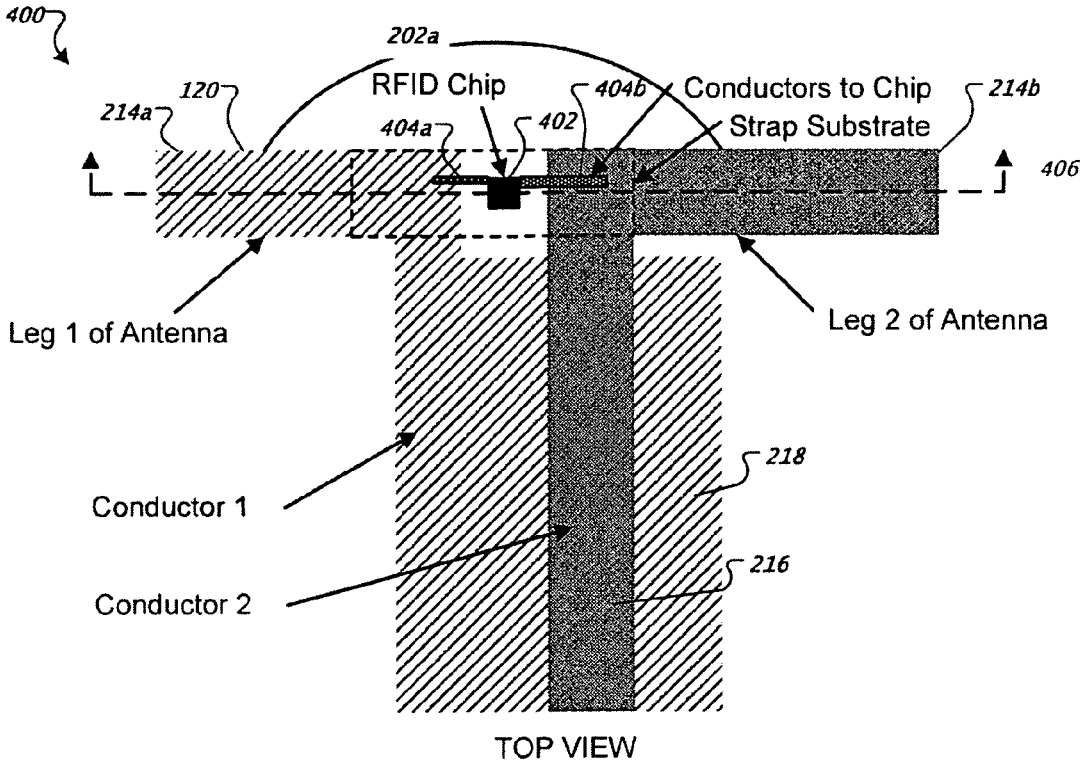
FIGS. 4A-C are block diagrams illustrating example energy transfer media coupled to an RFID chip.
Figure 4B:
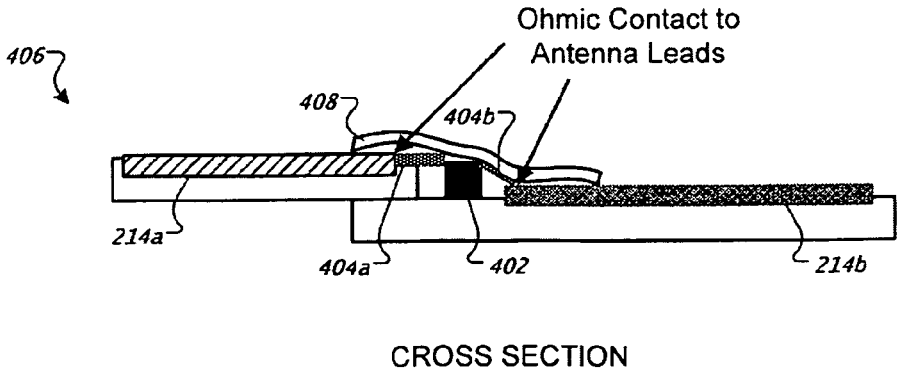
Figure 4C:
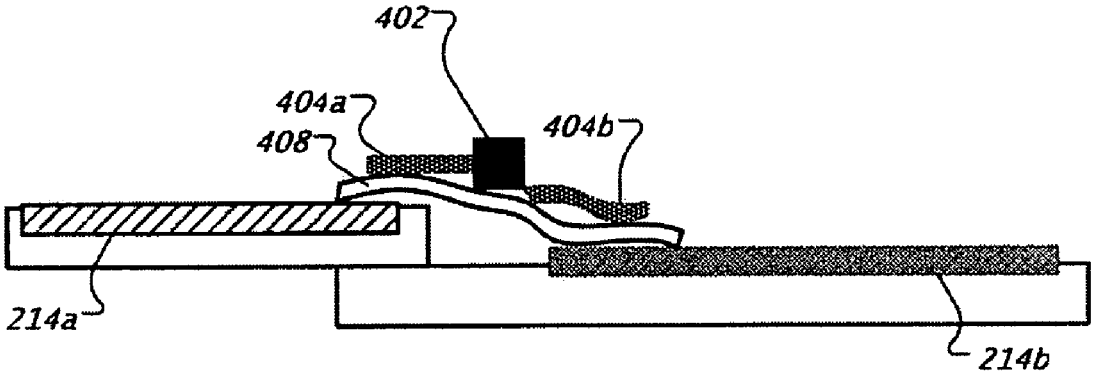

FIGS. 4A-C illustrate an example energy transfer media 120 coupled to an RFID chip 402 in accordance with some implementations of the present disclosure. For example, the RFID chip 402 may be directly connected to the energy transfer media 120. Referring to FIG. 4A, the antenna 202*a* is coupled to the RFID chip 402 such that RF signals are passively transferred directly with the RFID chip 402. In the illustrated implementation, the RFID chip 402 is at least coupled to the antenna 202*a* using the conductors 404*a* and 404*b*. The conductors 404*a* and 404*b* may be positioned at least adjacent the RFID chip 402 and at least adjacent a portion of the legs 214*a* and 214*b*, respectively. The conductors 404*a* and 404*b* may be a metal alloy including, for example, copper, silver, and/or other metals. In some implementations, the conductors 404*a* and 404*b* are electrically connected to the RFID chip using, for example, solder, pressed indium, and/or other types of connection. In some implementations, the antenna legs 214*a* and 214*b* are capacitively coupled to the conductors 404*a* and 404*b*. The antenna legs 214*a* and 214*b* may passively transfer RF signals to the conductors 404.

Referring to FIG. 4B, the cross section 406 illustrates the RFID chip 402 directly connected to the antenna 202. One end of the conductor 404 may be electrically connected to the RFID chip 402 and a different end may connected to the antenna leg 214. The conductors 404 may be connected using any suitable electrical connections such as, for example, a soldered connection, a mechanical connection, and/or other types. In this implementations, RF signals are passively transferred between legs 214 and the RFID chip 402 using a direct electrical connection. In some implementations, a layer 408 may protectively cover the RFID chip 402 and conductors 404.

Referring to FIG. 4C, the cross section 406 illustrates the RFID chip 402 being capacitively coupled to the antenna 202. In the illustrated implementation, the conductors 404 are spatially separated from the conductors 404 by a layer 408 such that the arrangement of the conductors 404, the layer 408, and the antenna legs 214 substantially form a capacitor. In doing so, RF signals may be passively transferred between the RFID chip 402 and the antenna 202*a* independent of an electrical connection. The layer 408 may be any suitable material such as a dielectric. In some implementations, the layer 408 is 20 mils or less.

Figure 5:
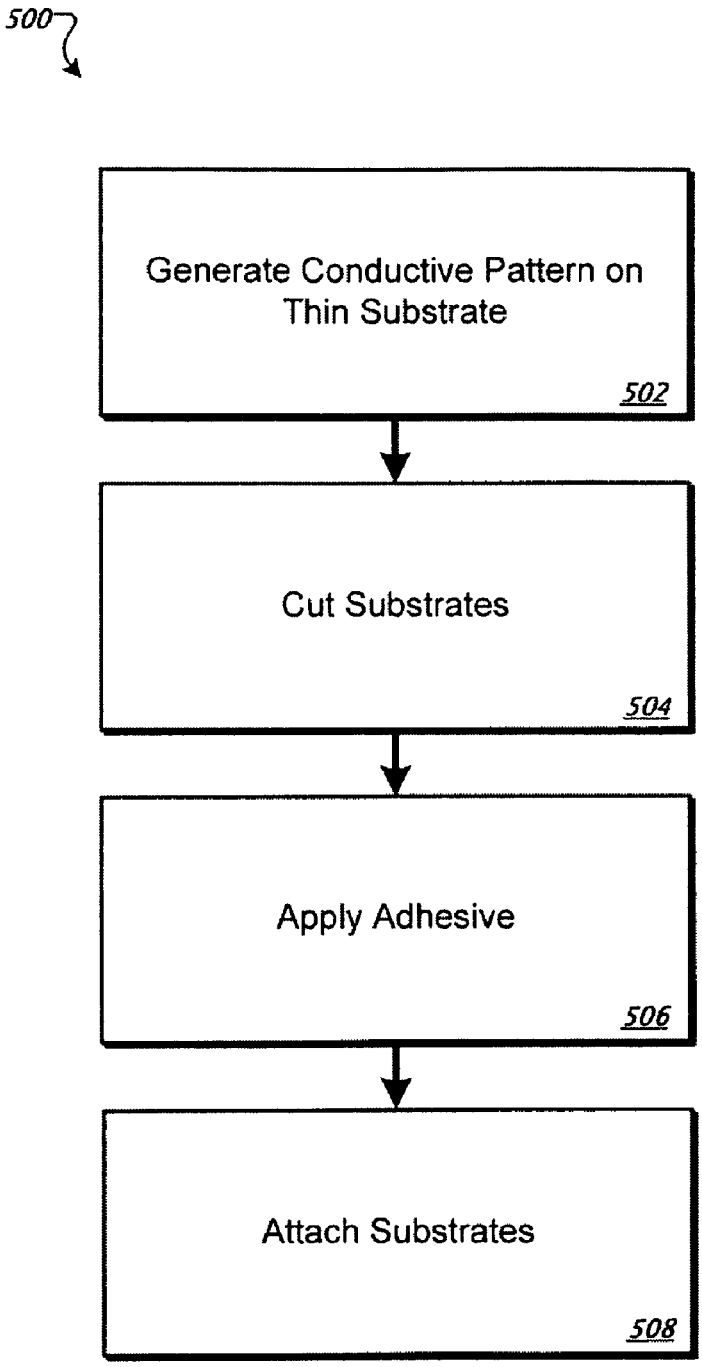
FIG. 5 is a flow chart illustrating an example method for manufacturing energy transfer media.

FIG. 5 is a flow chart illustrating an example method 500 for manufacturing energy transfer media in accordance with some implementations of the present disclosure. In particular, the example method 500 describes a technique for manufacturing media 120 of FIGS. 2A-F using continuous conductors that are spatially proximate. The method 500 is an example method for one aspect of manufacturing; a similar method, including some, all, additional, or different steps, consistent with the present disclosure, may be used to manufacture media 120.

The method 500 begins at step 502 where conductive patterns are generated on a thin substrates. For example, continuous conductors may be patterned on to a dielectric. In some implementations, the substrate may be 5 mils or less. At step 504, the substrates including the patterns are cut into a one or more designs. In some implementations, the design may be rectangular or other polygonal shape. Next, at step 506, an adhesive is applied to the substrates in at least locations that will overlap. In some implementations, an adhesive is applied to the location of the transmission line 216 and/or the ground plane 218. The substrates are attached using the adhesive at step 508. Returning to the example, the transmission line 216 and/or the ground plane 218 may be aligned and affixed to form the passive transmission path 204.

A number of embodiments of the invention have been described. Nevertheless, it will be understood that various modifications may be made without departing from the spirit and scope of the invention. Accordingly, other embodiments are within the scope of the following claims.

What is claimed is:

1. A signal transfer element configured to passively transfer RF signals between a first region and a second region, comprising:

a first conductor layer including a first continuous conductor configured as a first portion of a first antenna, a transmission line, and a first portion of a second antenna, wherein the first antenna and the second antenna are configured to wirelessly receive and transmit Radio Frequency (RF) signals; and a second conductor layer including a second continuous conductor configured as a second portion of the first antenna, a ground plane, and a second portion of the second antenna, wherein the first conductor layer and the second conductor layer are spatially proximate such that the transmission line and the ground plane are configured to passively transfer RF signals between the first antenna and the second antenna independent of an electrical connection between the first conductor layer and the second conductor layer.

2. The signal transfer element of claim 1, wherein the first portion of the first antenna comprises a first leg of the first antenna, the second portion of the first antenna comprises a second leg of the first antenna, the first portion of the second antenna comprises a first leg of the second antenna, the second portion of the second antenna comprises a second leg of the second antenna.

3. The signal transfer element of claim 1, wherein the first continuous conductor and the second continuous conductor comprise at least one of a copper alloy or a silver alloy.

4. The signal transfer element of claim 1, wherein the first continuous conductor and the second continuous conductor comprise at least one of a microstrip or a stripline.

5. The signal transfer element of claim 1, wherein the first conductor layer and the second conductor layer are substantially parallel.

6. The signal transfer element of claim 1, wherein the first conductor layer and the second conductor layer are separated by a distance of 20 mils or less.

7. The signal transfer element of claim 1, where an insulating layer forms the distances between the first conductor layer and the second conductor layer.

8. The signal transfer element of claim 1, wherein the ground plane comprises a first group plane, further comprising a second ground plane and a third ground plane spatially proximate the transmission line.

9. The signal transfer element of claim 1, wherein the first conductor layer and the second conductor layer are affixed to form the signal transfer element.

10. The signal transfer element of claim 1, wherein the transmission line is 2 feet or greater.

11. The signal transfer element of claim 1, wherein the signal transfer element is at least affixed to a surface of a container.

12. The signal transfer element of claim 1, wherein the RF signals passively transferred between the first antenna and the second antenna are in a frequency range from 125 KHz to 2.5 GHz.

13. The signal transfer element of claim 1, further comprising:

an RFID chip electrically coupled with the first antenna; and conductors connected to the RFID chip and at least spatially proximate the first antenna, wherein RF signals are passively transferred between the first antenna and the RFID chip using the conductors.

14. The signal transfer element of claim 13, wherein the conductors are connected to the first antenna.

15. The signal transfer element of claim 13, wherein the conductors are capacitively coupled to the first antenna.

16. The signal transfer element of claim 15, further comprising a dielectric layer is selectively positioned between the first antenna and the conductors.

17. The signal transfer element of claim 16, wherein the dielectric layer is 20 mils or less.

18. The signal transfer element of claim 13, further comprising a protective layer adjacent the RFID chip and the conductors.

* * * * *